United States Patent [19]

Leonhardt

[11] Patent Number: 4,746,026

[45] Date of Patent: May 24, 1988

[54] TAMPER-PROOF CLOSURE

[75] Inventor: Heinz Leonhardt, Bedburg, Fed. Rep. of Germany

[73] Assignee: Vereinigte Aluminium-Werke Aktiengesellschaft, Fed. Rep. of Germany

[21] Appl. No.: 41,602

[22] Filed: Apr. 22, 1987

[30] Foreign Application Priority Data

Apr. 23, 1986 [DE] Fed. Rep. of Germany ..... 3613782

[51] Int. Cl.[4] ..... B65D 41/34

[52] U.S. Cl. ..... 215/252

[58] Field of Search ..... 215/252

[56] References Cited

U.S. PATENT DOCUMENTS 4,511,053 4/1985 Brandes et al. ..... 215/252

4,610,367 9/1986 Massott et al. ..... 215/252

*Primary Examiner*—Donald F. Norton

*Attorney, Agent, or Firm*—Darby & Darby

[57] ABSTRACT

A closure for sealing threaded bottles, jars or similar containers, comprises a metallic cap and a plastic collar having an upper attachment part adapted to releasably engage said cap. The collar further includes an interior security ring spaced from the collar and attached thereto by means of fracturable integrally formed links and at least one non-fracturable connecting web. A plurality of claws adapted to engage the undersurface of the threaded portion of the container extends from the inner surface of the security ring.

8 Claims, 3 Drawing Sheets

TAMPER-PROOF CLOSURE

This invention relates to tamper-proof closures of the type which present an indication when the container has been opened.

BACKGROUND OF THE INVENTION

U.S. Pat. No. 4,610,367 of Massott et al discloses a tamper-proof closure for use with threaded containers. The Massott et al closure comprises a plastic sealing ring which engages a threaded metallic cap and a security ring attached to the collar by means of a multiplicity of fracturable retaining links. When the cap is unscrewed from the container, the links rupture and the security ring drops to provide an indication that the container has been opened. The collar and security ring are such that they can be readily removed from the container which is beneficial if the cap or container is to be recycled.

The Massott et al patent contains a description of various known types of tamper-proof closures and its description of the prior art is hereby incorporated by reference into this specification.

A problem with the closure of the Massott et al patent is that in some circumstances the signal that the container has been opened is not always readily apparent. The present invention is an improvement over the tamper-proof closure shown and described in the Massott et al patent in that it provides a more reliable indicator that the closure has been removed from the container.

French Pat. No. 2,528,393 discloses a security ring which is inserted into the container cap from the inside and hooked onto the cap. When the cap is unscrewed from the bottle, a claw is torn from the attachment part of the security ring and remains hanging on the bottle below the threaded portion. When bottles are to be redeemed, this type of closure is undesirable since the claw remains hanging on the bottle and must be removed laboriously before the bottle can be recycled. Likewise, with respect to the metal cap, the attachment parts of the security ring must be removed since the metal and plastic parts must be separated prior to recycling.

An object of the invention is to avoid these disadvantages and to provide a security device for containers which is easy to manufacture, securely connected with the container closure but which, after use, can be readily separated from both the container and the cap.

SUMMARY OF THE INVENTION

According to the invention, a plastic security collar of the type shown in the Massott et al patent, is attached to an interior security ring by means of a multiplicity of fracturable links and at least one non-fracturable connecting web. A plurality of discrete claws integrally formed with the security ring are adapted to engage the undercut surface of the threaded portion of a container. When the metal closure is unscrewed from the container, the claws grasp this undercut surface causing the fracturable links to be ruptured. However, the force is not sufficient to rupture the connecting web and the security ring therefore remains attached to the outer collar. The result is that the security ring drops, providing a highly visible indication that the container has been opened.

DETAILED DESCRIPTION

Figure 1:
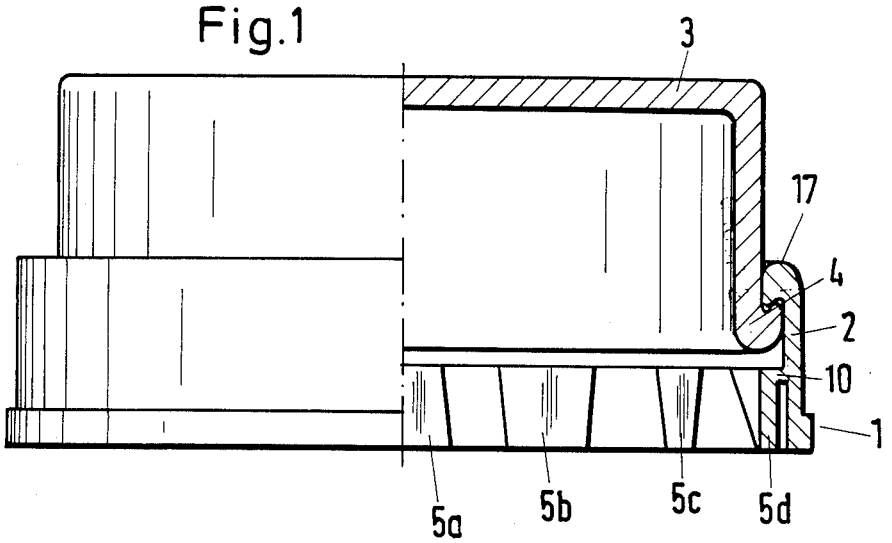
FIG. 1 is a side elevation view, in partial section, of a container closure and a security collar according to a first embodiment of the invention.
Figure 2:
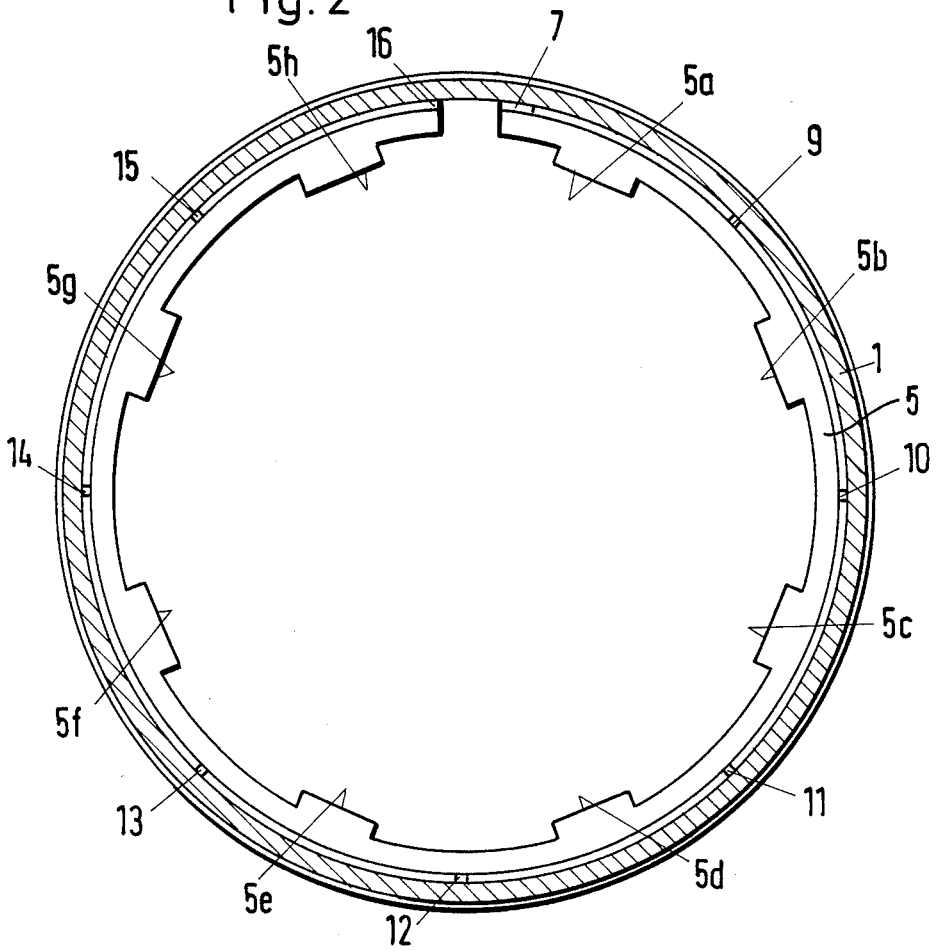
FIG. 2 is a sectional plan view of the safety ring of FIG. 1.

Referring to FIGS. 1 and 2, a plastic collar 1 having an upper attachment part 2 is shown attached to a metal closure 3. The metal closure 3 includes a lower rim or bead 4 which engages the upper attachment part 2 which is formed as a hook 17.

A security ring 5 is situated inside the collar 1 and attached to the collar by eight (for example) fracturable links 9–16. These links 9–16 are integrally formed with collar 1 and ring 5, and are adapted to be ruptured when the metal closure is unscrewed from the container. In addition, the security ring 5 is attached to the collar 1 by a non-fracturable connecting web 7, also integrally formed but of sufficient thickness that it will not rupture upon removal of the closure.

In accordance with the invention, a plurality of claws **5*a*–5*h* formed integrally with the security ring 5 are distributed circumferentially around the interior surface of ring 5. The claws 5*a*–5*h*** are generally wedge-shaped in cross-section and are adapted to engage the undersurface of a bottle rim beneath the threaded portion of the bottle when the closure is placed on the container.

FIGS. 1 and 2 show the metal closure 3 and plastic collar 1 before it is applied to the container. After the cap 3 and collar 1 have been assembled, the assembly is placed over the neck of a bottle and the wedge-shaped claws snapped under the rim of the threaded portion of the container. The threads are then formed in the metal cap 3 by conventional forming means causing the cap to mate with the threaded container.

When the bottle is opened by unscrewing the cap 3, the collar 1 tends to rise. This causes the claws **5*a*–5*h* to engage the undersurface of the bottle rim, in effect hooking the security ring 5. Continued torque on the cap 3 causes the links 9–16 to rupture but the force is not sufficient to break the connecting web 7. As a result, except where ring 5 is connected to collar 1 by connecting web 7**, the ring drops thereby providing a highly visible indication that the container has been opened.

The safety claws **5*a*–5*h* must yield sufficiently to allow the collar to be placed over the threads of the container, yet when the cap is unscrewed, they must be capable of hooking on to the undersurface of the threaded portion of the container to provide the resistance that causes the fracturable links 9–16 to rupture. The mobility of the claws 5*a*–5*d* can be adjusted in part by controlling the dimensions of the links 9–16 to ensure the desired properties. For optimum results, at least six and preferably eight safety claws equally spaced around the circumference of the ring, should be used. Links 9–16** should be located between adjacent claws.

Figure 3:
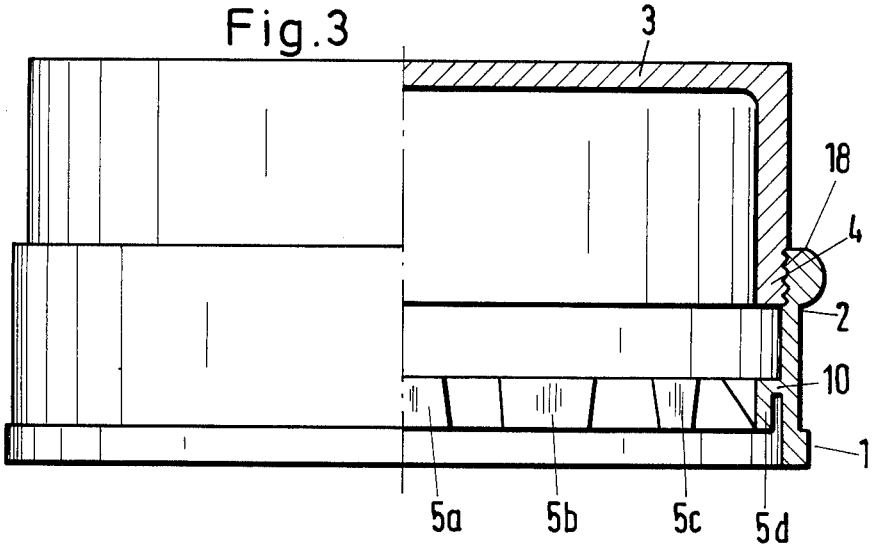
FIG. 3 is a side elevation view, in partial section, of a container closure and a security collar according to a second embodiment of the invention.
Figure 4:
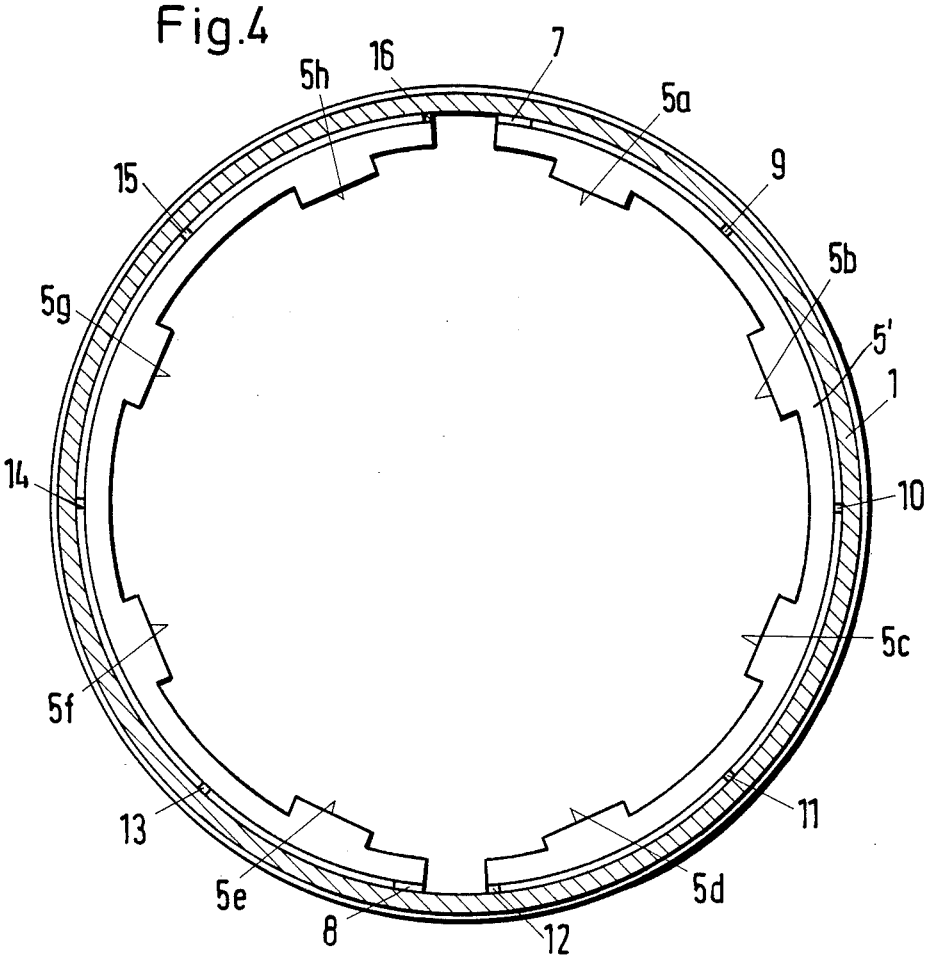
FIG. 4 is a sectional plan view of the security collar of FIG. 2.

FIGS. 3 and 4 show a second embodiment of the invention similar to the embodiment of FIGS. 1 and 2. The same numbers have been used to identify like parts. In the embodiment of FIGS. 3 and 4, the security ring 5 has been separated into semicircular rings 5' Ring 5''. Ring 5' is attached to collar 1 by a non-fracturable connecting web 7 and ring 5'' is connected to collar 1 by a non-fracturable connecting web 8.

Instead of the hooked arrangement for attaching the collar 1 to cap 3 of FIGS. 1 and 2, in the embodiment of FIGS. 3 and 4, the lower portion of the cap 4 is serrated and mates with a similarly serrated section 18 of the attachment part 2 of collar 1. The operation of the embodiment of FIGS. 3 and 4 is essentially the same as that described above.

For the purpose of recycling, it is ordinarily necessary to separate the metal cap 3 from the plastic collar 1. The arrangement of FIG. 3 is preferable in this respect since the metal and plastic parts can be simply pulled apart; however, it is necessary that the adhesion between the cap 3 and collar 1 be greater than the force required to rupture the links 9–16 when the cap is opened.

Figure 5:
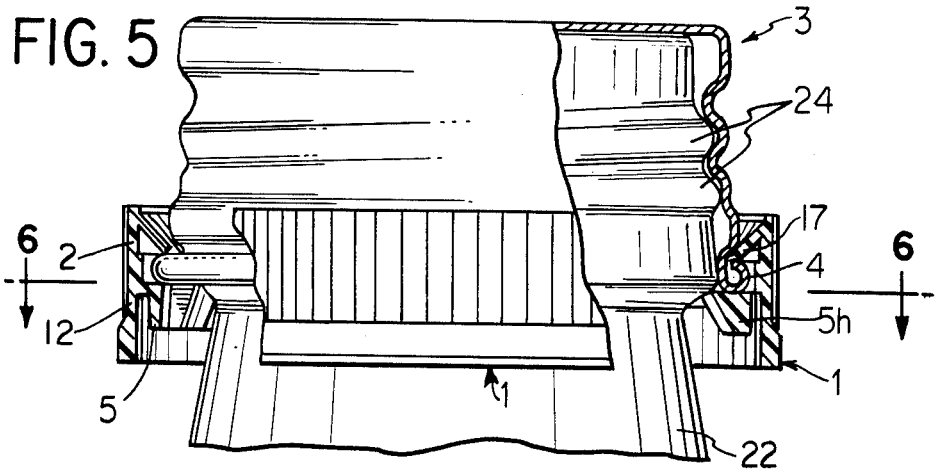
FIG. 5 is a side elevation view, in partial section, showing a preferred embodiment of the invention as it would appear in conjunction with a metal closure and glass container.
Figure 6:
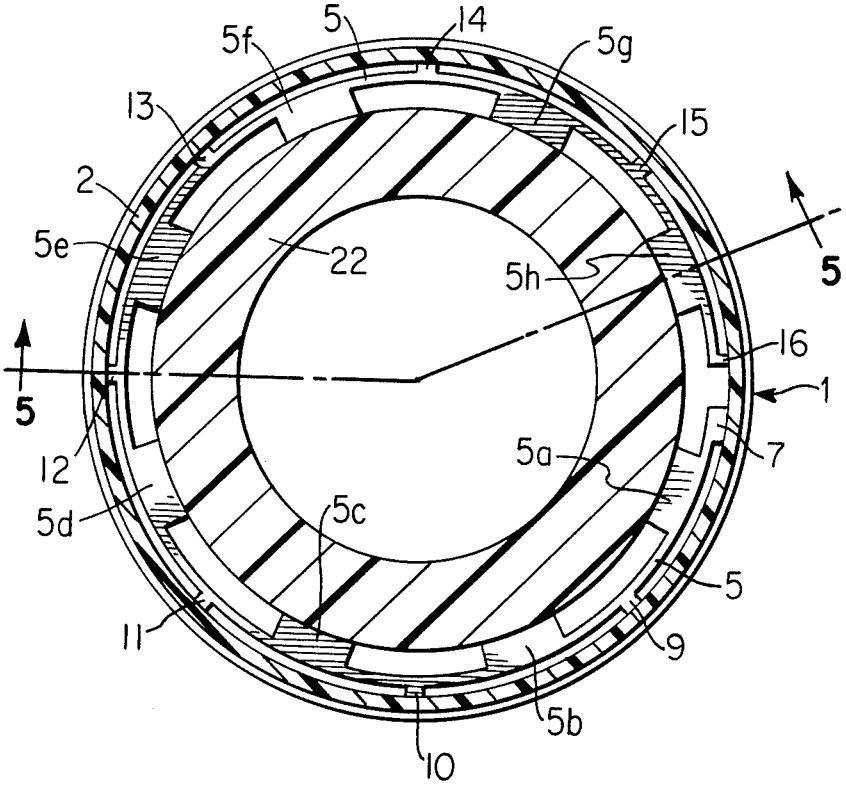
FIG. 6 is a sectional plan view along the line 6—6 of FIG. 5.

FIGS. 5 and 6 illustrate a preferred embodiment of the invention showing the combination of cap 3 and collar 1 applied to a bottle 22 having threads 24. The bottle 22 includes an undercut surface beneath the threaded portion which engages the claws 5*a*–5*h*. As shown in FIG. 6, the fracturable links 9–16 are thinner, and, therefore, more frangible than the connecting web 7. The link 16 may be slightly thinner than links 9–15 so that it will tend to be the first to rupture when closure 3 is unscrewed from bottle 22.

What is claimed is:

1. A closure for sealing threaded bottles, jars or similar containers, comprising:

a metallic cap;

a plastic collar having an upper attachment part adapted to releasably engage said cap, said collar further including an interior security ring spaced from said collar and attached thereto by means of a plurality of fracturable integrally formed links and at least one non-fracturable connecting web, said security ring further comprising a plurality of claws adapted to engage the undersurface of a rim beneath threaded portion of said bottles, jars or similar containers.

2. A closure according to claim 1, wherein said fracturable links are positioned between said safety claws.

3. A closure according to claim 2, wherein the means for securing the cap and collar comprise mating serrated surfaces on said cap and collar.

4. A closure according to claim 1, wherein there are between six and eight safety claws symmetrically distributed over the circumference of the security ring.

5. A closure for sealing threaded bottles, jars or similar containers, comprising:

a metallic cap;

a plastic collar having an upper attachment part adapted to releasably engage said cap, said collar further including an interior security ring including at least two sections spaced from said collar, with each section attached thereto by means of a plurality of fracturable integrally formed links and at least one non-fracturable connecting web, said security ring further comprising a plurality of claws adapted to engage the undersurface of a rim beneath the threaded portion of said bottles, jars or similar containers.

6. A closure according to claim 5 wherein said fracturable links are positioned between said safety claws.

7. A closure according to claim 6, wherein the means for securing the cap and collar comprise mating serrated surfaces on said cap and collar.

8. A closure according to claim 5, wherein there are between six and eight safety claws symmetrically distributed over the circumference of the security ring.

* * * * *